US005924567A

United States Patent [19]

Wenum

[11] Patent Number: 5,924,567

[45] Date of Patent: Jul. 20, 1999

[54] REUSABLE TOOTHBRUSH STORAGE CAP

[75] Inventor: John V. Wenum, Colgate, Wis.

[73] Assignee: Tess Corporation, Eau Claire, Wis.

[21] Appl. No.: 08/990,342

[22] Filed: Dec. 15, 1997

[51] Int. Cl.[6] ..... A45D 44/18

[52] U.S. Cl. ..... 206/362.3; 206/15.3; 220/324

[58] Field of Search ..... 206/361, 362.2, 206/362.3, 15.2, 15.3, 38, 37, 1.5; 220/283, 324, 326; 15/184, 185; 132/108

[56] References Cited

U.S. PATENT DOCUMENTS

| | | | |
|---|---|---|---|
| 2,655,968 | 10/1953 | Simmons | 206/362.3 |
| 2,679,315 | 5/1954 | Zegers | 206/361 |
| 3,127,985 | 4/1964 | Scott | 206/362.3 |
| 3,746,162 | 7/1973 | Bridges | 206/361 |
| 4,185,349 | 1/1980 | Papas . | |
| 4,780,923 | 11/1988 | Schultheiss . | |
| 4,835,813 | 6/1989 | Lorenzana et al. . | |
| 5,044,039 | 9/1991 | Picard . | |
| 5,048,144 | 9/1991 | Andrews . | |
| 5,052,556 | 10/1991 | Wilkinson . | |
| 5,139,142 | 8/1992 | Simon . | |
| 5,244,090 | 9/1993 | Keith | 206/15.3 |
| 5,638,839 | 6/1997 | Montoli | 220/324 |
| 5,645,167 | 7/1997 | Conrad | 206/15.3 |

OTHER PUBLICATIONS

"Promoting Better Oral Health", PHB brochure, pp. 1–37.

*Primary Examiner*—Paul T. Sewell
*Assistant Examiner*—Luan K. Bui
*Attorney, Agent, or Firm*—Andrus, Sceales, Starke & Sawall

[57] ABSTRACT

A reusable toothbrush storage cap for protecting bristles of a toothbrush is manufactured entirely as a single integral piece of molded plastic. The reusable toothbrush storage cap includes a bristle compartment and a hinged cover which are connected by a living hinge. The bristle compartment is defined by a bottom wall having vent/drain holes and an end wall, a front wall, and longitudinal sidewalls extending upward from the bottom wall. The living hinge is located at a top edge of the end wall and is connected to an end edge of the cover for the cap. The longitudinal sidewalls extend perpendicularly from the front wall to a transition location, and bend towards one another from the respective transition location to the end wall. The reusable toothbrush storage cap includes a first latching mechanism along the perpendicularly extending portion of the first longitudinal sidewall and a second latching mechanism along the perpendicularly extending portion of the second longitudinal sidewall. Each latching mechanism includes an outwardly extending tab on the longitudinal sidewall and a catch mechanism on the longitudinal edge of the cover. With this configuration, the reusable toothbrush storage cap is able to snugly fit a relatively large variety of toothbrush head sizes and shapes, and also is ensured to have reliable latching even after repeated use.

10 Claims, 2 Drawing Sheets

FIG. 2
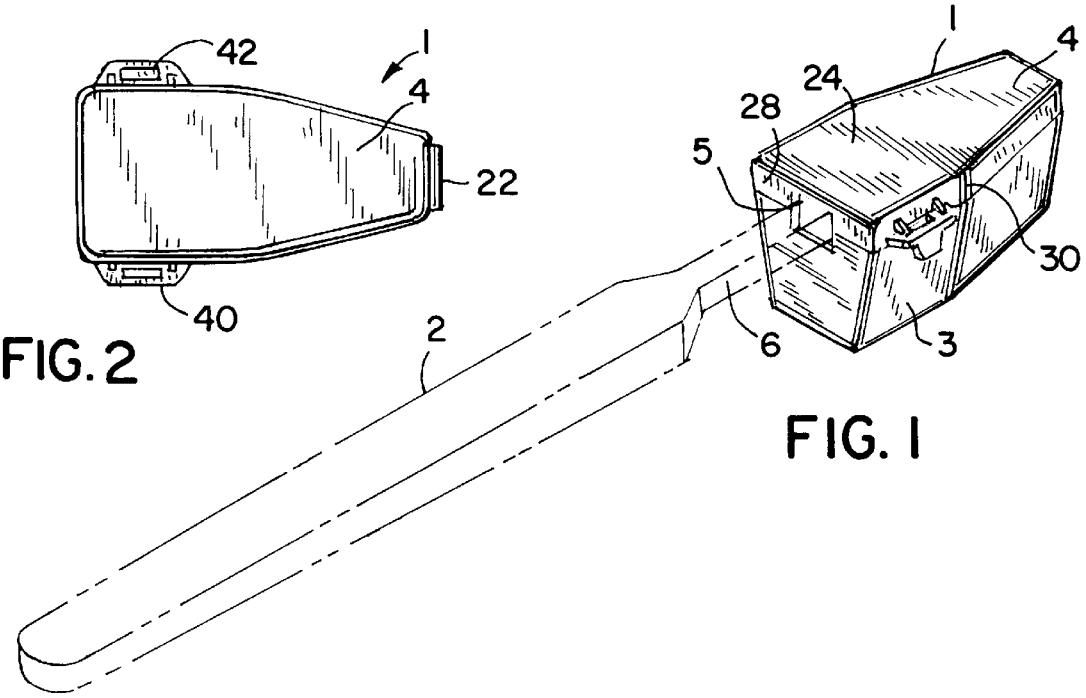
FIG. 1
FIG. 4
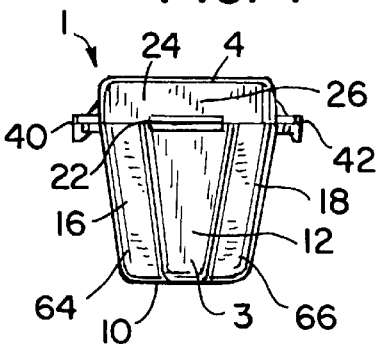
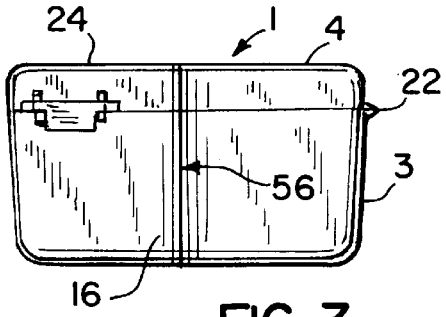
FIG. 3
FIG. 6
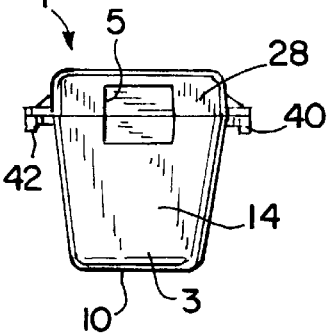
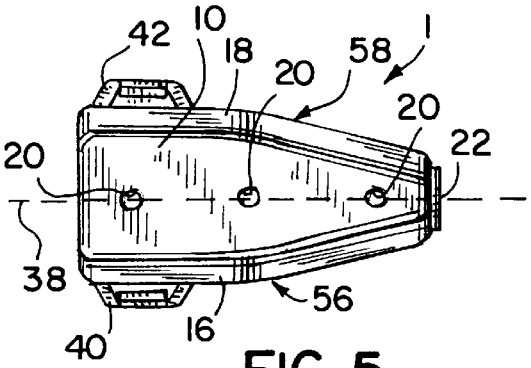
FIG. 5

FIG. 7
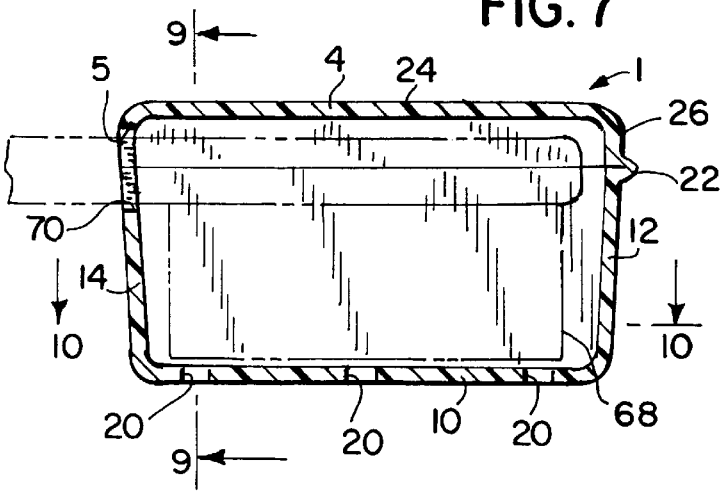
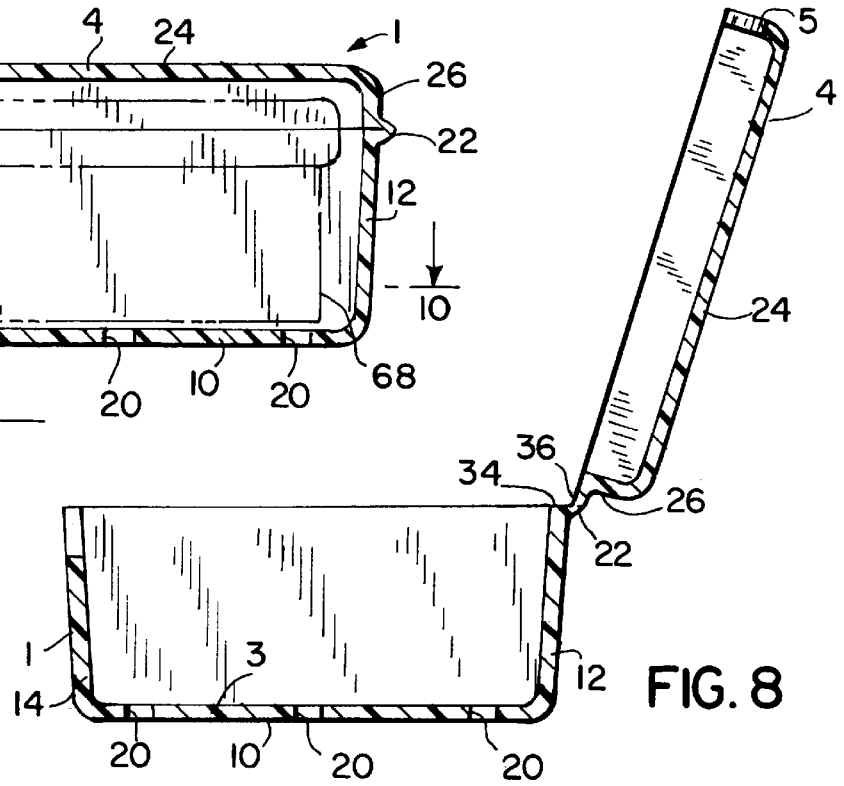
FIG. 8
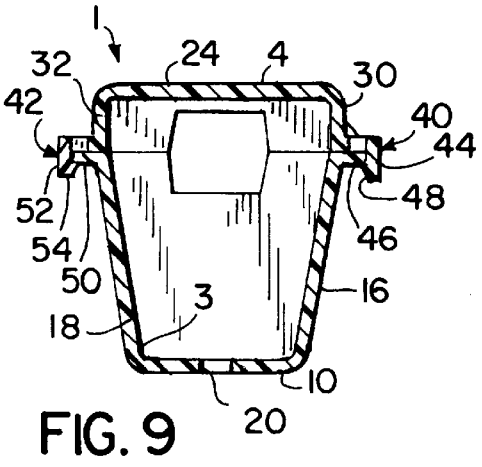
FIG. 9
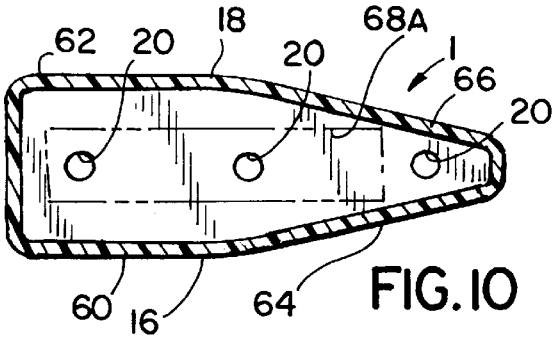
FIG. 10
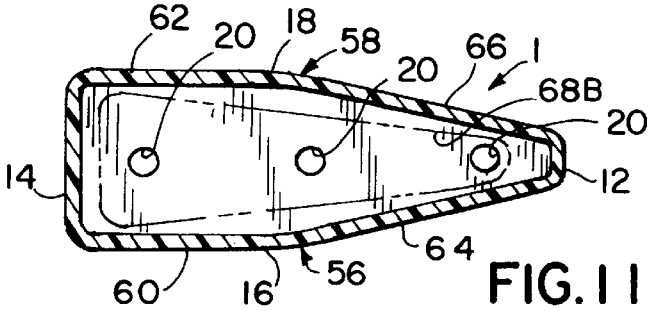
FIG. 11

REUSABLE TOOTHBRUSH STORAGE CAP

FIELD OF THE INVENTION

The invention relates to oral hygiene products, and in particular, to reusable toothbrush storage caps.

BACKGROUND OF THE INVENTION

Toothbrush storage caps fit over the head of a toothbrush, and protect the toothbrush bristles from dirt, grime and damage. Toothbrush storage caps are frequently used by travelers, and also by others who routinely carry toothbrushes such as orthodontic patients.

The prior art includes reusable toothbrush storage caps, as well as disposable toothbrush covers. One type of disposable toothbrush cover attaches directly to the head of the toothbrush. The advantage of this disposable toothbrush cover is its compact nature. On the other hand, many people prefer to purchase reusable toothbrush storage caps.

Reusable toothbrush storage caps are typically made from molded plastic (e.g., molded polypropylene). The molded plastic caps normally include a bristle compartment and a hinged cover. The toothbrush head lies in the bristle compartment longitudinally. The neck of the toothbrush passes through an opening located through the front wall of the bristle compartment and the front wall of the cover. One or more living hinges are molded between one of the longitudinal walls of the bristle compartment and a longitudinal edge of the cover. To keep the cover closed, one or more latch mechanisms are provided along the opposite longitudinal wall of the bristle compartment and the corresponding longitudinal edge of the cover, respectively. With this design, it is necessary that the longitudinal edges of the cap be straight to accommodate the one or more living hinges. After repeated use, storage caps with this design tend to distort slightly and the latch mechanisms become ineffective.

Toothbrush heads come in several shapes (e.g. rectangular, tapered, etc.) and sizes. Because it is difficult to fit a wide variety of toothbrushes snugly into the same compartment, conventional toothbrush caps tend to rattle on odd-shaped toothbrush heads. In one commercially available cap, the longitudinal sidewalls of the bristle compartment are tapered inward as the sidewalls extend downward. In this design, the inwardly tapered longitudinal sidewalls push the bristles together when the storage cap is used on a toothbrush. While this design tends to reduce rattling, it also distorts the toothbrush bristles and could possibly prematurely degrade the performance of the toothbrush.

BRIEF SUMMARY OF THE INVENTION

The invention is a reusable toothbrush storage cap configuration that maintains the effectiveness of the latch mechanisms even after repeated use. The configuration also enables the longitudinal sidewalls of the bristle compartment and the longitudinal side edges of the hinged cover to be non-linear. By allowing the longitudinal edges to be non-linear, the toothbrush storage cap can be designed to be compact, yet accommodate a wide range of toothbrush head shapes and sizes.

A reusable toothbrush storage cap in accordance with the preferred embodiment of the invention is molded from polypropylene. An opening for a toothbrush neck passes through a front wall of the bristle compartment and a front wall on the hinged cover. A living hinge is molded between an endwall of the bristle compartment and the corresponding edge of a hinged cover. The storage cap includes at least two latching mechanisms: one along one longitudinal side of the cap and the other along the opposite longitudinal side of the cap. The design of the cap is preferably symmetrical along its longitudinal axis, and the first and second latching mechanisms are preferably symmetrically located to one another.

The preferred latching mechanisms are a tab and catch design in which the latching member on the respective sidewall of the bristle compartment is an outwardly extending tab and the mating latching member on the longitudinal edge of the cover is a catch having a lip designed to engage the outwardly extending tab. Because of these two opposed latching members, the cover remains reliably shut when in use. On the other hand, the cover can be opened conveniently when desired by squeezing together the longitudinal sidewalls of the bristle compartment. The opposing latch mechanisms are robust, and remain effective for prolonged periods of repeated use.

It is important to note that the living hinge is located along the interface between the endwall of the bristle compartment and the end edge of the cover, rather than along the longitudinal sidewall of the bristle compartment and the longitudinal side edge of the cover. This enables the use of a living hinge without requiring that the longitudinal sidewall of the bristle compartment and the longitudinal side edge of the cover be straight or linear. Therefore, bends or curves can be put into the longitudinal sidewalls to improve strength and resiliency of the walls.

In the preferred embodiment of the invention, the reusable toothbrush storage cap includes a bristle compartment that is configured optimally to accommodate a wide variety of toothbrush shapes and sizes. The bristle compartment has a bottom wall that preferably includes vent and/or drain holes therethrough. A front wall and an endwall as well as longitudinal sidewalls extend upward from the bottom wall to define the bristle compartment. The front wall and the endwall are preferably perpendicular to the bottom wall. The length of the endwall between the longitudinal sidewalls is less than the length of the front wall between the longitudinal sidewalls. Preferably, the longitudinal sidewalls taper outward slightly as the sidewalls extend upward from the bottom wall. Although slightly tapered, the part of the sidewalls adjacent the front wall preferably extend perpendicularly away from the front wall. At a transition location which ranges between ⅓ and ⅔ of the distance between the front wall and the endwall, the longitudinal sidewalls preferably turn inward at a slight angle (e.g. approximately 11.75°), and continue in this direction towards the endwall (i.e., slight two-dimensional taper of sidewalls adjacent endwall). The depth of the bristle compartment as well as the location of the lower edge of the opening through the front wall of the bristle compartment for the toothbrush neck are selected so that bristles of a typical toothbrush will suspend freely within the bristle compartment. On the other hand, the slight two-dimensional taper of the longitudinal sidewalls adjacent the endwall helps to provide a compact design, and can also provide some realignment of worn bristles.

The cover of the storage cap is sized to mate flush with the top edges of the walls of the bristle compartment, except at the toothbrush neck opening. The cover preferably has a top wall, and the edges are preferably defined by short downwardly extending walls which mate against the top of the walls of the bristle compartment. The head of the toothbrush fits within the downwardly extending walls of the cover, and therefore these dimensions are preferably selected to accommodate a wide range of bristle head geometries. It has been found that the selection of the geometry of the bristle compartment previously described (i.e. longitudinal sidewalls extending perpendicularly from the front wall until a transition point at which the walls taper towards one another) accommodates a relatively wide range of toothbrush head sizes and shapes in a fairly snug manner.

Other features and advantages of the invention may be apparent to those skilled in the art upon inspecting the following drawings and description thereof.

BRIEF DESCRIPTION OF THE DRAWINGS

FIG. 1 is a perspective view of a reusable toothbrush storage cap in accordance with the invention showing a toothbrush in phantom;

FIG. 2 is a top view of the reusable toothbrush storage cap shown in FIG. 1;

FIG. 3 is a left side elevational view of the reusable toothbrush storage cap shown in FIG. 1, the right side elevational view being similar thereto;

FIG. 4 is an end elevational view of the reusable toothbrush storage cap shown in FIG. 1;

FIG. 5 is a bottom plan view of the reusable toothbrush storage cap shown in FIG. 1;

FIG. 6 is a front elevational view of the reusable toothbrush storage cap shown in FIG. 1;

FIG. 7 is a longitudinal section view of the reusable toothbrush storage cap in FIG. 1 showing a toothbrush in phantom;

FIG. 8 is a view similar to FIG. 7 showing a cover of the reusable toothbrush storage cap in an open position;

FIG. 9 is a sectional view taken along line 9—9 in FIG. 7;

FIG. 10 is a sectional view taken along line 10—10 in FIG. 7 which shows rectangular toothbrush bristles in phantom;

FIG. 11 is a view similar to FIG. 10 showing tapered toothbrush bristles in phantom.

DETAILED DESCRIPTION OF THE DRAWINGS

FIG. 1 shows a reusable toothbrush storage cap 1 in accordance with the preferred embodiment of the invention being used to protect the bristles of a toothbrush 2. The reusable toothbrush storage cap 1 includes a bristle compartment 3 and a hinged cover 4. The hinge cover 4 can be opened to enable a toothbrush bristle head to be placed within the bristle compartment 3, and latched closed to store the toothbrush bristle head within the bristle compartment 3 and protect the toothbrush bristles. An opening 5 is provided through a front wall of the bristle compartment 3 and a front wall of the hinged cover 4 for the neck 6 of the toothbrush 2.

Referring now to all of the drawings (FIGS. 1–11), the bristle compartment 3 is defined by a bottom wall 10, an end wall 12, a front wall 14, a first longitudinal sidewall 16 and a second longitudinal sidewall 18. The end wall 12, the front wall 14, the first longitudinal sidewall 16 and the second longitudinal sidewall 18 all extend upward from the bottom wall 10 of the bristle compartment 3. Vent/drain holes 20 are provided through the bottom wall 10. The preferred diameter of the three vent/drain holes 20 is about 0.1 inches.

The cover 4 is attached to the bristle compartment 3 via a living hinge 22. The top cover 4 includes a top wall 24, an end wall 26, a front wall 28, a first longitudinal sidewall 30, and a second longitudinal sidewall 32. The end wall 26, the front wall 28, the first longitudinal sidewall 30 and the second longitudinal sidewall 32 each extend downward from a periphery of the top wall 24 of the cover 4. When the cover 4 is closed, the lower edges of the downwardly extending walls 26, 28, 30 and 32 of the cover 4 mate with the top edge 34 of the upwardly extending walls 12, 14, 16, 18 of the bristle compartment 3 except at the opening 5 for the neck 6 of the toothbrush 2.

The reusable toothbrush storage cap 1 is molded preferably from polypropylene (alternatively, polypropinate) with the hinged cover in a completely open position. The width of all the walls 10, 12, 14, 16, 18, 24, 26, 28, 30, 32 is preferably approximately 0.05 inches.

The living hinge 22 is located between the top edge 34 of the end wall 12 of the bristle compartment 3 and the edge 36 of the end wall 26 of the cover 4. The top edge 34 of the end wall 26 of the bristle compartment 3 and the edge 36 of the end wall 26 of the cover 4 are both straight and substantially parallel to one another to accommodate the living hinge 22. The hinge 22 preferably spans substantially the entire length of the respective edges 34, 36 of the end walls 12, 26. The hinge 22 preferably extends about ⅛ inch between the end wall 12 on the bristle compartment 3 and the end wall 26 on the cover 4 when the cover is opened. The living hinge 22 is perpendicular to a longitudinal, vertical plane 38 passing through the reusable toothbrush storage cap 1.

The reusable toothbrush storage cap 1 includes a first latching mechanism 40 along the first longitudinal side of the cap 1 and a second latching mechanism 42 along the second longitudinal side of the cap 1. The first latching mechanism 40 has a latching member 44 on the first longitudinal sidewall 30 of the cover 4, see FIG. 9. The first latching mechanism 40 also includes a mating latching member 46 on the first longitudinal wall 16 of the bristle compartment 3. The latching member 46 on the first longitudinal sidewall 16 of the bristle compartment 3 is an outwardly extending tab. The latching member 44 on the first longitudinal wall 30 of the cover 4 is a catch 44 which includes a lip 48 that engages the outwardly extending tab 46 on the first longitudinal extending sidewall 16. Likewise, the second latching mechanism 42 has a latching member 50 on the second longitudinal sidewall 18 of the bristle compartment 3 which is an outwardly extending tab 50. The second latching mechanism 42 also has a mating latching member 52 on the second longitudinal edge of the cover 4. The latching member 52 on the second longitudinal edge of the cover 4 is a catch that includes a lip 54 to engage the outwardly extending tab 50 on the second longitudinal sidewall 18 of the bristle compartment 3.

It is preferred that the entire storage cap 1 be symmetrical with respect to the longitudinal vertical plane 38 shown in FIG. 5. The length of the end wall 26 of the cover 4 between the sidewalls 30 and 32 is substantially less than the length of the front wall 28 between the sidewalls 30 and 32. The preferred length of the front wall 28 is approximately 0.75 inches and the preferred length of the end wall 26 is approximately 0.27 inches, however these dimensions can be altered depending on the particular application.

The longitudinal sidewalls 16, 18 of the bristle compartment 3 extend away perpendicularly from the front wall 14 of the bristle compartment 3. The longitudinal sidewall 16, 18 of the bristle compartment 3 continue to extend substantially perpendicularly to a respective transition location 56, 58 along the longitudinal sidewalls 16, 18. In other words, the longitudinal sidewalls 16, 18 are substantially perpendicular to the front wall 14 for the bristle compartment 3 between the front wall 14 and the respective transition locations 56, 58. From the transition locations 56, 58 to the end wall 12 (see reference numerals 64, 66), the longitudinal sidewalls 16, 18 taper slightly towards each other, e.g. at an angle between 9°–15°, preferably 11.75° with respect to the perpendicularly extending portions 60, 62 of the longitudinal sidewalls 16, 18. The longitudinal sidewall 16, 18 for the bristle compartment 3 taper outward slightly as the sidewalls 16, 18 extend upward from the bottom wall 10. Preferably, the longitudinal sidewalls 16, 18 extend outward at an angle of 8½° as the sidewalls 16, 18 extend upward from the bottom wall 10 of the bristle compartment 3. The inwardly tapered portions 64, 66 of the sidewalls 16, 18 are thus slightly tapered in two dimensions. As can be best seen in FIG. 7, the lower edge 70 of the opening 5 through the cap 1 for the neck 6 of the toothbrush 2, is located high enough so that the toothbrush bristles 68 will normally suspend above the bottom wall 10 of the toothbrush compartment 3.

While the preferred design of the bristle compartment 3 is chosen for aesthetic purposes, there are several functional features of the geometry. For instance, the combination of the perpendicularly extending portions 60, 62 along with the two dimensionally tapered portions 64, 66 of the longitudinal sidewalls 16, 18 allows the bristle compartment 3 to fit a wide range of toothbrush sizes and shapes, yet fit relatively snugly (see FIGS. 10 and 11). Note that the toothbrush bristles 68A in FIG. 10 and 68B in FIG. 11 both fit relatively snugly with respect to the two dimensionally tapered portions 64, 66 of the longitudinal sidewalls 16, 18 even though the shape and size of the bristles 68*a* are significantly different than that of 68*b*.

As noted above, the lower edge 36 of the downwardly extending walls 26, 28, 30, and 32 on the cover 4 mate against the upper edge 34 of the walls 12, 14, 16, 18 of the bristle compartment 3. The head of the toothbrush 2 fits within the downwardly extending walls 26, 28, 30, 32 of the cap 4, and the configuration previously described (i.e., the longitudinal sidewalls 30, 32 having a perpendicularly extending portion from the front wall 28 to a respective transition location 56, 58 and tapering inward towards one another from the transition location 56, 58 to the end wall 26) is adapted well to fit toothbrushes 2 having either rectangular or tapered heads.

The latching mechanisms 40, 42 are located on the respective perpendicularly extending portion 60, 62 of the longitudinal sidewalls 16, 18, 30, 32 of the bristle compartment 3 and the cover 4, respectively. Placing the latching mechanisms 40, 42 in this location provides sturdy, durable, and convenient to use latching mechanisms. The latching mechanisms 40, 42 are open by squeezing together the perpendicularly extending portions 60, 62 of the longitudinal sidewalls 16, 18 of the bristle compartment 3 so that the outwardly extending tabs 46, 50 on the bristle compartment sidewalls 16, 18 clear the catches 48, 54 on the cover 4. The longitudinal sidewalls 16, 18 can be squeezed together most effectively to open the storage cap 1 by applying inward pressure at or near the transition locations 56, 58. The presence of the bends in the sidewalls 16, 18 at the transition locations 56, 58 provide strength to the longitudinal sidewalls 16, 18 and resilience which is important so that the sidewalls 16, 18 do not become deformed over repeated use. It is also desirable that the walls 16, 18 have sufficient thickness, e.g. 0.05 inches in the preferred embodiment. Resilience in the sidewalls 16, 18 is important to maintain the locking mechanism tabs 46, 50 in the proper locations so that the locking mechanisms 40, 42 remain effective even after repeated use. Nonetheless, the opposing latching mechanisms 40, 42 remain effective even if the longitudinal sidewalls 16, 18 become slightly deformed.

The invention has been shown with respect to a preferred embodiment of the invention, and specific dimensions and/or configurations are merely exemplary. Various modifications, equivalents and alternatives may be possible and should be considered to fall within the scope of the following claims.

I claim:

1. A reusable toothbrush storage cap for protecting bristles of a toothbrush, the reusable toothbrush storage cap comprising:

a bristle compartment defined by a bottom wall, a first longitudinal sidewall, a second longitudinal sidewall, a front wall, and an endwall, the longitudinal sidewalls, the front wall and the endwall each extending away from the bottom wall to form a protective compartment for the bristles of a toothbrush, wherein the endwall has a length between the longitudinal sidewalls that is less than the length of the front wall between the longitudinal sidewalls;

a hinged cover that can be opened to enable a toothbrush bristle head to be placed within the bristle compartment and latched closed to store the toothbrush bristle head within the bristle compartment to protect the toothbrush bristles, the cover including a top wall, a first longitudinal side edge, a second longitudinal side edge, a front edge and an end edge;

an opening for a neck of the toothbrush which passes at least in part through the front wall of the bristle compartment;

a living hinge connecting the cover to the bristle compartment, the living hinge being located between the end wall of the bristle compartment and the end edge of the cover;

a first latching mechanism having a latching member on the first longitudinal sidewall of the bristle compartment and a mating latching member on the first longitudinal edge of the cover; and a second latching mechanism having a latching member on the second longitudinal sidewall of the bristle compartment and a mating latching member on the second longitudinal edge of the cover; wherein each longitudinal sidewall extends perpendicularly away from the front wall towards the end wall for a selected distance to a transition location along each respective longitudinal sidewall;

each longitudinal sidewall tapers slightly towards the other longitudinal sidewall as it extends from the respective transition location to the end wall;

the latching member on the first longitudinal sidewall of bristle compartment is an outwardly extending tab and the mating latching member on the first longitudinal edge of the cover is a catch that includes a lip to engage the outwardly extending tab;

the latching member on the second longitudinal wall of the bristle compartment is an outwardly extending tab and the mating latch member on the second longitudinal edge of the cover is a catch having a lip to engage the outwardly extending tab on the second longitudinal sidewall of the bristle compartment; and the respective outwardly extending tabs are located on the portion of the respective longitudinal sidewall between the front wall and the respective transition location.

2. A reusable toothbrush storage cap as recited in claim 1 wherein:

the latching member on the first longitudinal sidewall of the bristle compartment is an outwardly extending tab and the mating latching member on the first longitudinal edge of the cover is a catch that includes a lip to engage the outwardly extending tab; and the latching member on the second longitudinal sidewall of the bristle compartment is an outwardly extending tab and the mating latch member on the second longitudinal edge of the cover is a catch having a lip to engage the outwardly extending tab on the second longitudinal sidewall of the bristle compartment.

3. A reusable toothbrush storage cap as recited in claim 1 wherein the cap is manufactured entirely as a single integral piece by molding plastic, the plastic consisting of either a polypropylene material or a polypropinate material, and all wall widths being approximately 0.05 inches.

4. A reusable toothbrush storage cap as recited in claim 1 wherein the longitudinal sidewalls taper slightly outward as the longitudinal sidewalls extend upward from the bottom wall between the respective transition locations along the longitudinal sidewalls and the end wall.

5. A reusable toothbrush storage cap as recited in claim 1 wherein the taper of the longitudinal sidewalls at the respective transition locations to the end wall is approximately 9°–15° with respect to the portions of the longitudinal sidewalls extending perpendicularly from the front wall.

6. A reusable toothbrush storage cap as recited in claim 1 wherein the cap is symmetrical with respect to a longitudinal vertical plane passing through the bottom wall of the bristle compartment and the top wall of the cover.

7. A reusable toothbrush storage cap as recited in claim 1 wherein the cover includes an end wall, a front wall, and longitudinal sidewalls all extending downward from the top wall of the cover and all mating against the top edge of the corresponding wall on the bristle compartment except at the opening for the neck of the toothbrush.

8. A reusable toothbrush storage cap for protecting bristles of a toothbrush, the reusable toothbrush storage cap comprising:

a bristle compartment defined by a bottom wall, a first longitudinal sidewall, a second longitudinal sidewall, a front wall, and an end wall, the longitudinal sidewalls, the front wall and the end wall each extending away from the bottom wall to form a protective compartment for the bristles of a toothbrush, wherein the end wall has a length along the longitudinal sidewalls that is less than the length of the front wall between the longitudinal sidewalls, each longitudinal sidewall extends away from the front wall perpendicularly towards the end wall for a selected distance to a respective transition location along each longitudinal sidewall, and each longitudinal sidewall tapers slightly toward the other longitudinal sidewall as it extends from the respective transition location to the end wall, the tapered portion of each longitudinal sidewall also tapering slightly outward as the longitudinal sidewall extends from the bottom wall upward;

a hinge cover that can be opened to enable a toothbrush bristle head to be placed within the bristle compartment and latched closed to store the toothbrush bristle head within the bristle compartment to protect the toothbrush bristles, the cover including a top wall, a first longitudinal sidewall, a second longitudinal sidewall, a front wall, and an end wall, each extending downward from the top wall and mating against a top edge of the corresponding wall on the bristle compartment except at an opening for a neck of a toothbrush which passes through the front walls of the cover and the bristle compartment when the cover is closed;

a first latching mechanism having a latching member on the first longitudinal sidewall of the bristle compartment and a mating latching member on the first longitudinal edge of the cover; and a second latching mechanism having a latching member on the second longitudinal sidewall of the bristle compartment and a mating latching member on the second longitudinal edge of the cover; wherein the latching member on the first longitudinal sidewall of the bristle compartment is an outwardly extending tab and the mating latching member on the first longitudinal edge of the cover is a catch that includes a lip to engage the outwardly extending tab:

the latching member on the second longitudinal wall of the bristle compartment is an outwardly extending tab and the mating latch member on the second longitudinal edge of the cover is a catch having a lip to engage the outwardly extending tab on the second longitudinal sidewall of the bristle compartment; and the respective outwardly extending tabs are located on the portion of the respective longitudinal sidewall between the front wall and the respective transition location.

9. A reusable toothbrush storage cap as recited in claim 8 wherein the taper of the longitudinal sidewalls from the respective transition location to the end wall is approximately 9°–15° with respect to the perpendicular portions of the longitudinal sidewalls.

10. A reusable toothbrush storage cap as recited in claim 8 wherein the taper of the longitudinal sidewalls as the longitudinal sidewalls extend upward from the bottom wall is approximately 8½°.

* * * * *